US006273737B1

(12) United States Patent
Furusho et al.

(10) Patent No.: US 6,273,737 B1
(45) Date of Patent: Aug. 14, 2001

(54) IC CARD CONNECTOR HAVING CARD EJECTING FUNCTION

(75) Inventors: Hidetaka Furusho; Wataru Oguchi, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/532,452

(22) Filed: Mar. 23, 2000

(30) Foreign Application Priority Data

Mar. 24, 1999 (JP) ..... 11-079905

(51) Int. Cl.[7] ..... H01R 13/62
(52) U.S. Cl. ..... 439/159
(58) Field of Search ..... 439/159

(56) References Cited

U.S. PATENT DOCUMENTS 5,533,906 * 7/1996 Abe ..... 439/159

FOREIGN PATENT DOCUMENTS 9-82411 3/1997 (JP) .

WO97/10691 3/1997 (WO) .

* cited by examiner

*Primary Examiner*—Brian Sircus
*Assistant Examiner*—Javaid Nasri
(74) *Attorney, Agent, or Firm*—Brinks Hofer Gilson & Lione

(57) ABSTRACT

An IC card connector having a housing provided with terminals, a frame attached to the housing, and an ejecting lever supported on the frame. The frame is a flat plate provided with a pair of mounting holes, and a connecting portion recessed in the direction of plate thickness between the mounting holes. The ejecting lever has a raised portion at the central part, jutting out in the direction of plate thickness, and inserted through from one mounting hole into the other mounting hole astride the connecting portion. The connecting portion is overlapped on the raised portion, so that the surface of the raised portion will be approximately flush with the surface of the flat plate of the frame, and the back side of the connecting portion will be approximately flush with the back side of the ejecting lever. The ejecting lever is also rotatably supported between the connecting portion and the raised portion, thereby pushing with the ejecting lever to drive out an IC card off terminals of the housing.

8 Claims, 5 Drawing Sheets

12
11
11a
11c
11d
11b
11e
10
11c
11d
11b
11e
11f
13j
15
13
13e
13k
13c
13d
13a
15c
13l
15d
13j
13i
13b
13h
13h
14c
17
14
14
14a
18
14a

IC CARD CONNECTOR HAVING CARD EJECTING FUNCTION

BACKGROUND OF THE INVENTION

1. Field of the Invention

This invention relates to an IC card connector mounted in equipment and used for insertion and removal of an IC card.

2. Description of Related Art

Generally, an IC card connector is provided with a push rod slidably held in the direction of insertion of the IC card, and an ejecting lever for driving out the IC card which has been accepted in the IC card connector, by turning the end portion thereof according to the movement of the push rod in the direction of insertion.

As disclosed in Japanese Patent Laid-Open No. Hei 9-82411 for example, the IC card connector has a guide frame into which the IC card is to be inserted; an insulating housing fixed in the innermost side part of the frame, for accepting the IC card to be inserted into the frame; an ejecting lever made of a metal plate having a long hole and disposed on the frame; and a push rod slidably installed, in the direction of insertion, on either one of the right and left ends of the frame, and extended and held in the direction of insertion. Furthermore, on the surface of the frame there is provided a caulking portion formed in a shape of projection by caulking the frame. Then, the caulked portion is fitted and caulked in the long hole of the ejecting lever, to thereby rotatably hold the ejecting lever on the frame.

The end portion of the ejecting lever is turned to push the IC card in the opposite direction of insertion in accordance with the movement of the push rod in the direction of insertion, pushing the IC card out from the frame.

The conventional IC card connector has such a problem that the caulked portion of the frame thus formed projects outwardly to hold the ejecting lever which turns on the frame; and the caulked portion is fitted in the long hole of the ejecting lever. According to this configuration, the IC card connector increases in thickness, making it impossible to realize a thin IC card connector against the recent trend toward decreasing the thickness of the whole body of the equipment.

Where a thin caulked portion is employed, there is the fear that, in the event of a trouble of the caulked portion, the ejecting lever will fail to smoothly move within the long hole of the ejecting lever when the ejecting lever is pushed to remove the IC card from the connector. Also, if the caulked portion is reduced only in thickness without decreasing its length, the ejecting lever will rise off the frame, coming out of position.

SUMMARY OF THE INVENTION

An object, therefore, of this invention is to provide a thin IC card connector, in which an operating power required at an initial stage of ejection of the IC card has been increased so that the IC card may be ejected largely out, thereby insuring smooth, reliable operation of the equipment.

As the first means to solve at least one of the above-described problems, the IC card connector has a housing provided with terminals, a frame mounted on the housing, and an ejecting lever supported on the frame. A pair of mounting holes are formed in the flat plate of the frame. Between the mounting holes, a connecting portion recessed in the direction of plate thickness is provided. A raised portion is formed on the ejecting lever in the direction of plate thickness, protruding in the opposite direction of the connecting portion. The ejecting lever is inserted through one of the mounting holes into the other mounting hole astride the connecting portion. Then, with the raised portion overlapped on the connecting portion, the surface of the raised portion is set nearly flush with the surface of the flat plate of the frame, and also the back side of the connecting portion is set nearly flush with the back side of the ejecting lever. The ejecting lever is rotatably supported between the connecting portion and the raised portion, so that the IC card connected to the terminals on the housing may be pushed for ejection by means of the ejecting lever.

As the second means of solution, there are formed contact portions which can be in contact with the frame, on both ends of the raised portion. One of the contact portions is used as a fulcrum. With the turning of the ejecting lever, the fulcrum moves from one contact portion to the other contact portion.

Furthermore, as the third means of solution, the connecting portion is bridged in the direction of width of the ejecting lever.

Furthermore, as the fourth means of solution, a pair of protruding portions are formed on the raised portion of the ejecting lever, protruding in the opposite direction of the raised portion to thereby hold the connecting portion at a given interval and accordingly to restrict the movement of the ejecting lever.

Other objects, features and advantages of the invention will be apparent from the following detailed description taken in connection with the accompanying drawings.

DESCRIPTION OF THE PREFERRED EMBODIMENTS

Figure 1:
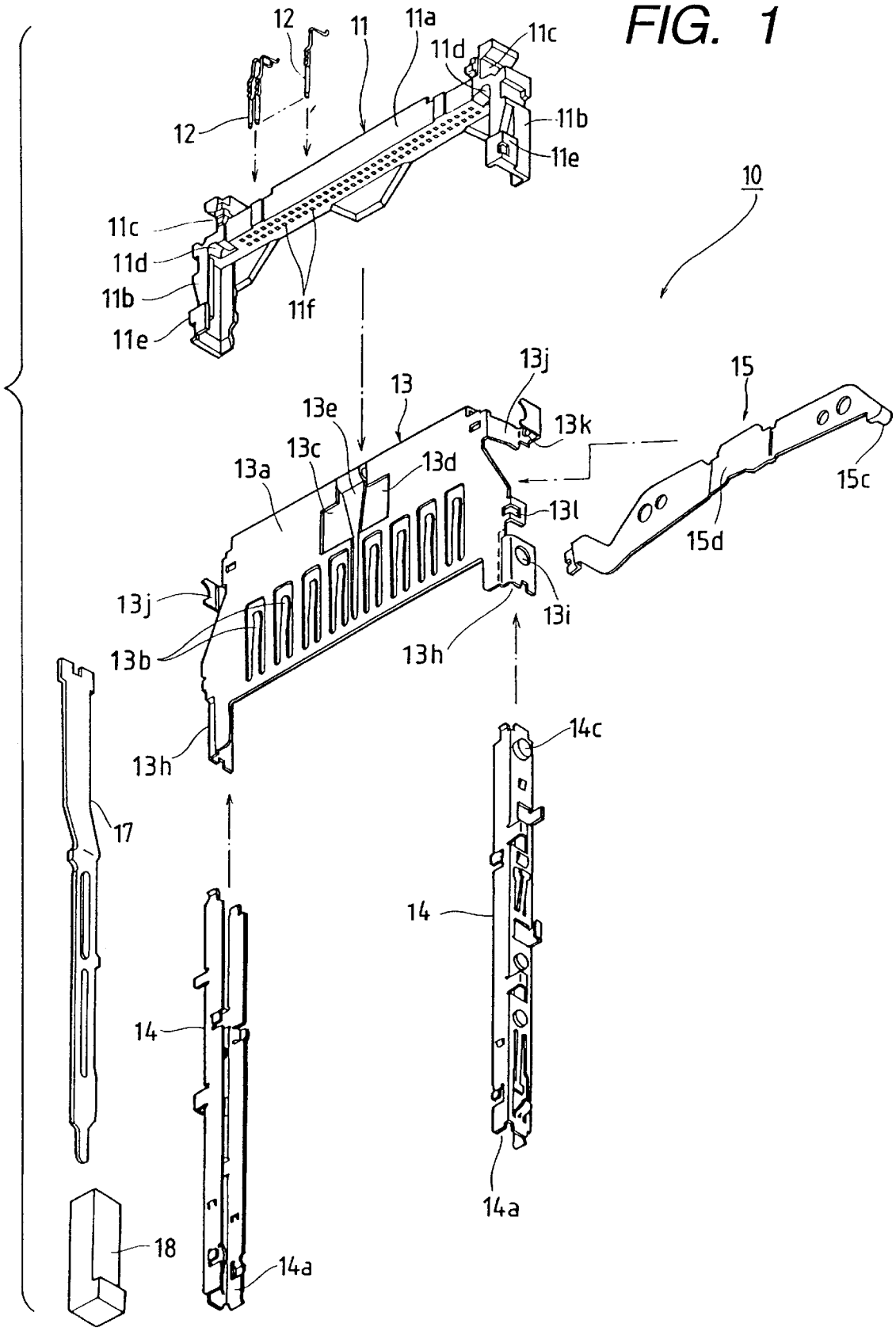
FIG. 1 is an exploded perspective view of an IC card connector of one embodiment according to this invention.
Figure 2:
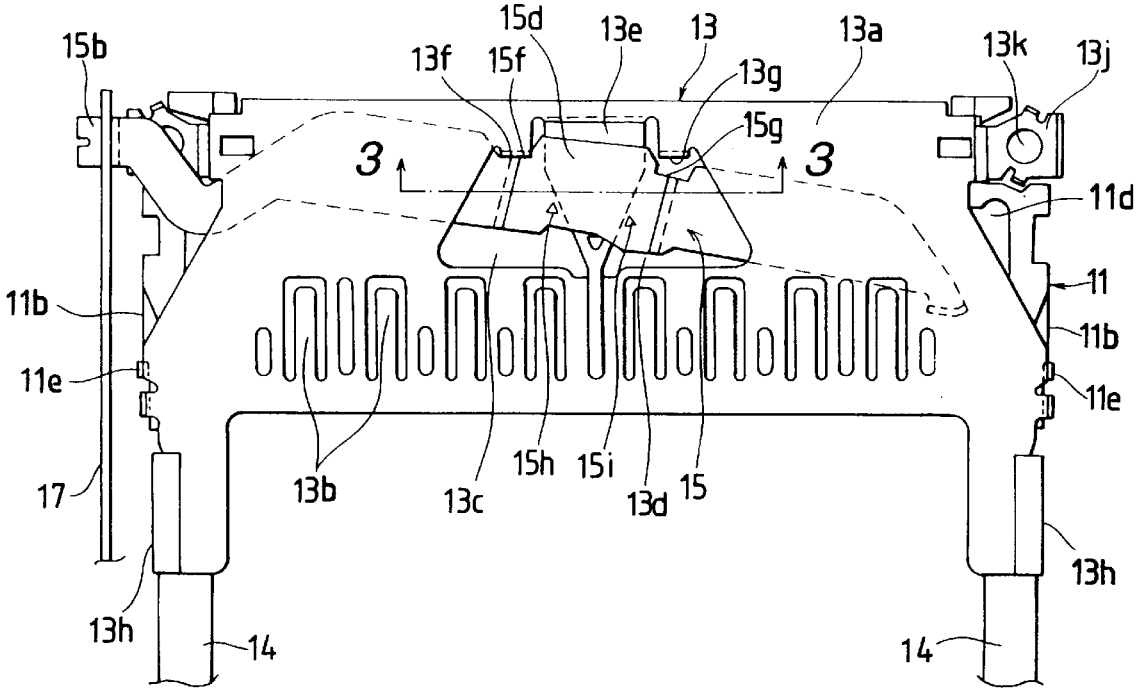
FIG. 2 is a plan view showing a major portion of the IC card connector of one embodiment according to this invention.

Referring to FIGS. 1 to 9, one embodiment of an IC card connector 10 according to this invention will be explained. A U-shaped housing 11 made of a synthetic resin by molding, as shown in FIG. 1, has abase section 11*a*, a pair of U-shaped guide portions 11*b* extending forward (downward in the drawing) from both ends of the base section 11*a*, a pair of cutouts 11*c* provided on both sides of the rear part, a pair of recesses 11*d* provided adjacently to the cutouts 11*c* in the front part on both sides of the base section 11*a*, and engaging projections 11*e* provided in the front part of both guide portions 11*b*.

The base section 11*a* has in its side wall a plurality of pin holes 11*f* laterally juxtaposed in two lines, upper and lower. In these pin holes 11*f*, a plurality of pin terminals 12 made of a metallic material are installed by pressing.

The frame 13 made of a single metal plate has an approximately trapezoidal flat plate 13*a* as shown in FIG. 1 and FIGS. 4 to 6. On this flat plate 13*a* a plurality of contact pieces 13*b* are systematically formed, each being provided with elasticity by a cutout and slightly bent downward.

Adjacently to the free end of the contact piece 13*b*, the frame 13 is provided with a pair of mounting holes 13*c* and 13*d* which are formed by cutting out into an approximately rectangular shape at the center of the flat plate 13*a*, and a slightly recessed connecting portion 13*e* of an inverted triangular form between the mounting holes 13*c* and 13*d*.

On a part of the edge portion of the mounting holes 13*c* and 13*d*, there are formed bent portions 13*f* and 13*g* which are bent inward from behind correspondingly to the mounting holes 13*c* and 13*d*.

On both the right and left sides of the front side of the flat plate 13*a*, a pair of connecting portions 13*h* are formed, being bent downward approximately at a right angle from the flat plate 13*a*.

In the connecting portion 13*h* a connecting hole 13*i* is formed through so as to be connected to a later-described guide member.

On both the right and left sides of the rear side of the flat plate 13*a*, a pair of mounting portions 13*j* are formed, being bent downward approximately at a right angle from the flat plate 13*a*.

The forward end of these mounting portions 13*j* is bent outward into an L shape, and a through hole 13*k* is formed in the forward end.

Between the mounting portion 13*j* and the connecting portion 13*h*, there is formed an engaging pawl 131 partly cutout and bent approximately at a right angle from both the right and left sides of the flat plate 13*a*, so that the engaging pawl 131 will be connected to a fitting projection 11*e* of the housing 11.

On the rear side of the flat plate 13*a* there is formed a shield portion 13*m* bent approximately at a right angle from the flat plate 13*a*, oppositely to a part of the pin terminals 12 pressed in the housing 11.

Then, the mounting portion 13*j* of the frame 13, after being bent fully back at the forward end, is securely attached and grounded to an unillustrated printed-circuit board by using a mounting means such as a screw in a hole 13*k*.

A pair of guide members 14, as shown in FIG. 1, are made of a metal plate such as a stainless steel, and have a guide groove 14*a* formed by bending into a U-shape in a cross section. The guide members 14 are arranged so that the guide grooves 14*a* will face to each other.

On the rear end of the guide member 14 there is provided a projecting portion 14*c*, which is formed to face outward to connect the guide member 14 to the frame 13.

To connect the frame 13 to the guide member 14, the projecting portion 14*c* is fitted in the jointing hole 13*i* of the frame 13 and the projecting portion 14*c* projecting out of the jointing hole 13*i* is jointed into one body by caulking.

Figure 7:
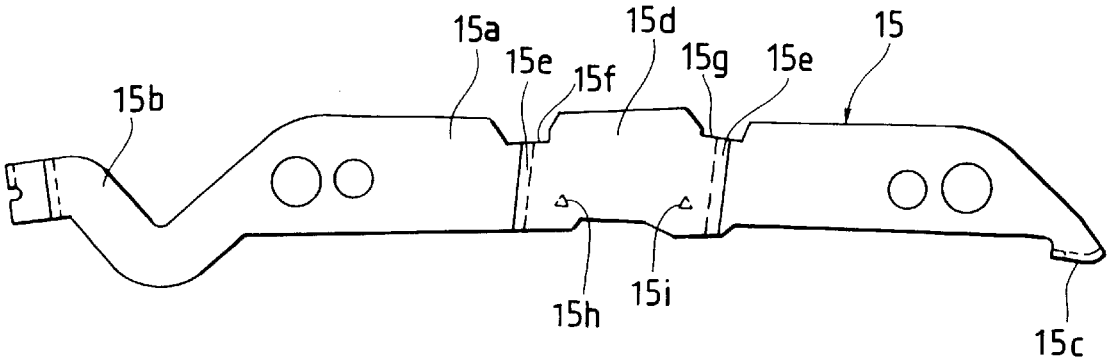
FIG. 7 is a plan view of an ejecting lever of the IC card connector of one embodiment according to this invention.
Figure 8:
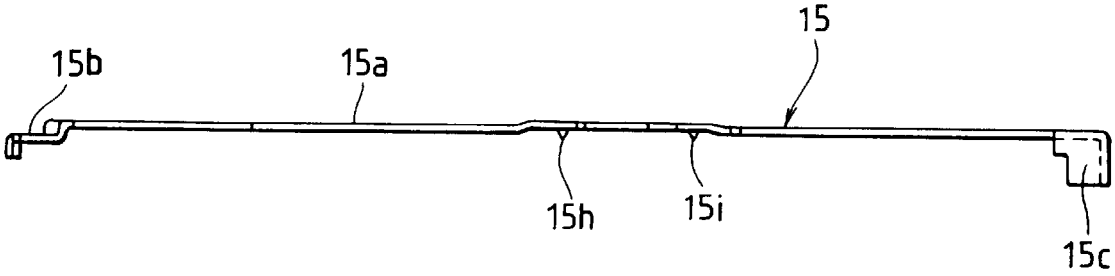
FIG. 8 is a front view of the ejecting lever of the IC card connector of one embodiment according to this invention.

An ejecting lever 15 is made of a single high-rigidity metal plate such as a stainless steel plate. As shown in FIGS. 1, 7 and 8, the ejecting lever 15 has a base section 15*a*, a V-shaped retaining portion 15*b* provided in one end of the base section 15*a*, and a pushing portion 15*c* formed by bending a part of the base section 15*a* approximately at a right angle.

At the center of the base section 15*a*, there is provided an approximately trapezoidal raised portion 15*d* slightly raised in the direction of plate thickness. And a stepped portion 15*e* is formed at a boundary between the raised portion 15*d* and the base section 15*a*.

Furthermore, at both corners on the rear side (upper part in FIG. 7) of the raised portion 15*d*, a pair of cutouts 15*f* and 15*g* are provided. These cutouts 15*f* and 15*g* which serve as contacting portion are formed by cutting in the direction in which the raised portion 15*d* decreases in width.

The ejecting lever 15 can turn within the frame 13, using either one of the pair of cutout portions 15*f* and 15*g* as a fulcrum.

On the front side of the raised portion 15*d*, a pair of projections 15*h* and 15*i* are formed projecting in the opposite direction of raising in the direction of plate thickness, in such positions as to hold the connecting portion 13*e* when installed to the frame 13.

The push rod 17 is produced of a rigid, slender metallic material, which has an engaging slot 17*a* in one end. On the other end an operating portion 18 made of a resin is securely attached. In the engaging slot 17*a*, the end of the retaining portion 15*b* of the ejecting lever 15 is engaged.

Figure 9A:
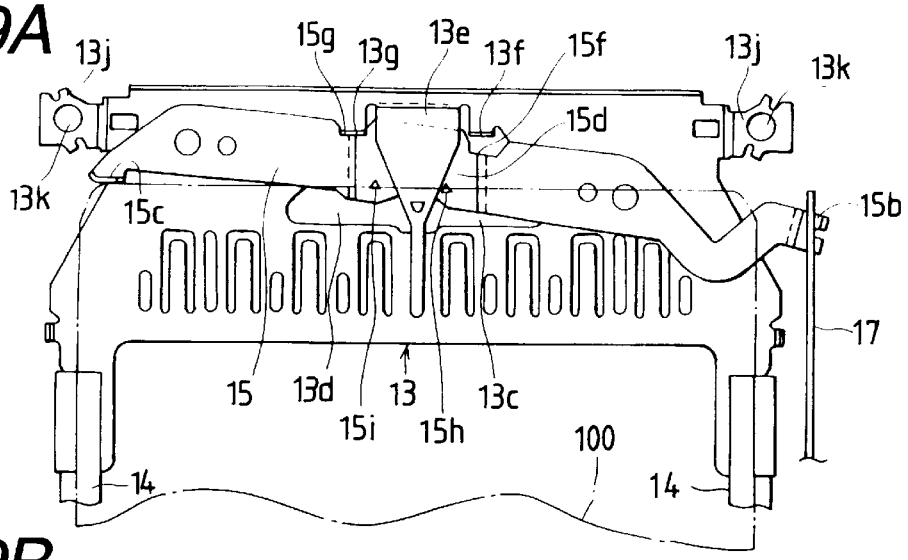
FIG. 9A is a plan view showing the IC card position prior to ejection from the IC Card connector of one embodiment according to this invention.

The push rod 17 is so installed on one of the guide members 14 as to be movable in the direction of insertion of an IC card 100 (see FIGS. 9A, B, C). When the operating portion 18 of the push rod 17 is pressed, the push rod 17 moves to the rear side, to move also to the rear side the retaining portion 15*b* of the ejecting lever 15 engaged in the engagement slot 17*a*, thereby turning the ejecting lever 15 whereby the pushing portion 15*c* of the ejecting lever 15 discharges the IC card 100 out to the inserting port side.

The IC card connector 10 thus configured is assembled as follows.

First, in the housing 11, one end of each pin terminal 12 is pressed into the pin hole 11*f* in the rear side wall of the base section 11*a*, in such a manner that the one end projects out into a space enclosed with the base section 11*a* and two guide portions 11*b*.

In the frame 13, the contact piece 13*b*, the jointing portion 13*h*, and the shield portion 13*m* are bent by a pressing process or by means of a jig; one end of the finished ejecting lever 15 is inserted from the back side into either one of the mounting holes 13*c* and 13*d*; and subsequently the one end is inserted from the surface side of the frame 13 into the other mounting hole 13*c* or 13*d* so as to straddle the connecting portion 13*e*, to thereby jointing the connecting portion 13*e* to the raised portion 15*d*. Therefore, the raised portion 15*d* of the ejecting lever 15, and its vicinity are exposed from the surface of the flat plate 13*a* of the frame 13 through the mounting holes 13*c* and 13*d*.

Next, the frame 13 fitted with the ejecting lever 15 is mounted on the housing 11; the mounting portion 13*j* is fixedly attached by a snap to the cutout portion 11*c*; and the engaging pawl 131 is fixedly attached by a snap to the fitting projection 11*e*. At this time, the pushing portion 15*c* of the ejecting lever 15 is arranged in the recess portion 11*d* or in its vicinity.

Next, in the guide member 14, with the projecting portion 14*c* projecting outward of the guide member 14 aligned with the engaging hole 13*i* on the inner side of the frame 13, the projecting portion 14*c* is inserted into the engaging hole 13*i* and secured by caulking.

On the outer side of one of the guide members 14, the push rod 17 on one end of which the operating portion 18 is disposed is longitudinally movably supported, and the retaining portion 15*b* of the ejecting lever 15 is engaged in the engaging slot 17*a* in the other end, thus completing the IC card connector 10.

The IC card connector 10 thus completed is installed and used in such equipment as electronic equipment. To install the IC card connector 10, the other end of each pin terminal 12 is fixedly connected by soldering to an electrically conductive pattern provided on the printed-circuit board which is a mounting member, and the housing 11 is screwed to the printed-circuit board through the mounting hole 13*k*.

Next, a contacting portion between the connecting portion 13*e* of the frame 13 and the raised portion 15*d* of the ejecting lever 15 will be explained.

Figure 3:
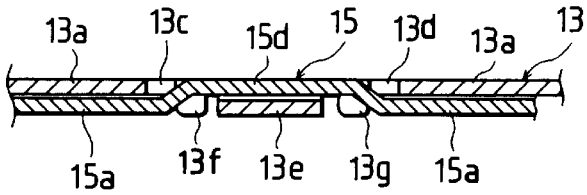
FIG. 3 is a sectional view showing a major portion taken along line 3—3 in FIG. 2.
Figure 4:
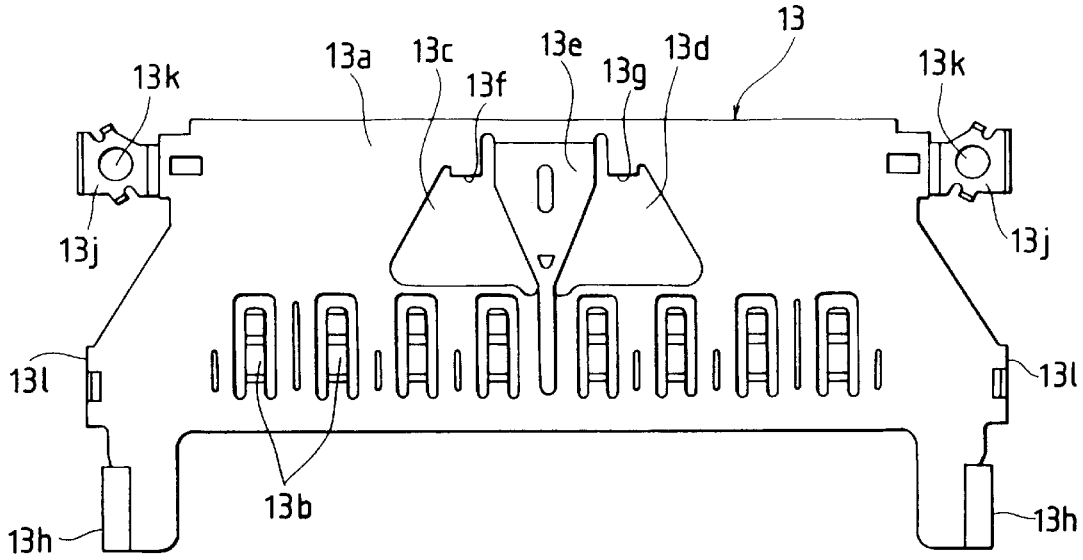
FIG. 4 is a plan view of a frame of the IC card connector of one embodiment according to this invention.
Figure 5:
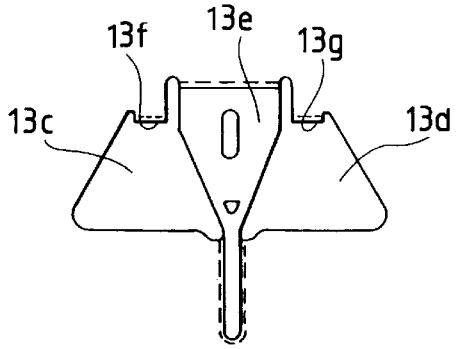
FIG. 5 is an enlarged plan view of a major portion of the frame.
Figure 6:
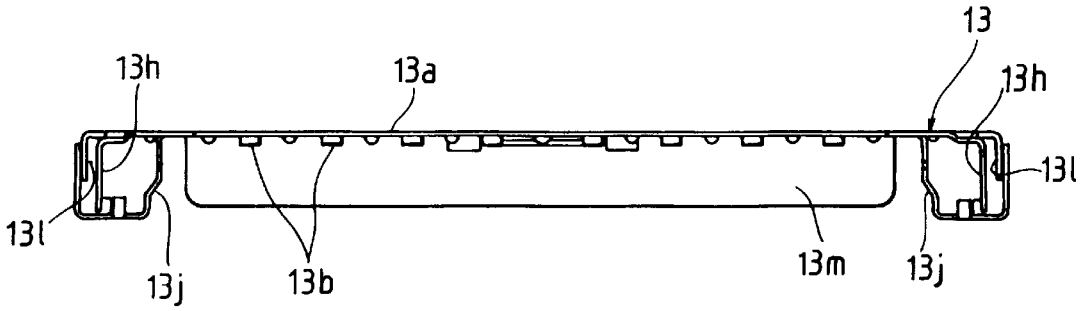
FIG. 6 is a front view of the frame of the IC card connector of one embodiment according to this invention.

As shown in FIG. 3, when the ejecting lever 15 is installed to the frame 13, the connecting portion 13*e* interposed between the pair of mounting holes 13*c* and 13*d* of the frame 13 is recessed by about the same amount as its plate thickness, so that the back side of the connecting portion 13*e* is nearly flush with the back side of the ejecting lever.

Furthermore, when the raised portion 15*d* of the ejecting lever 5 is attached to the connecting portion 13*e* of the frame 13, the raised portion 15*d* which is formed by raising by about the same amount as the plate thickness of the base section 15*a*, thus becoming nearly flush with the surface of the flat plate 13*a* of the frame 13.

Therefore, the plate thickness of the ejecting mechanism section of the IC card 100 is determined by the plate thickness of the frame 13 and the plate thickness of the ejecting lever 15 when the ejecting lever 15 is installed to the frame 13.

Next, referring to FIG. 9A to FIG. 9C, ejection of the IC card 100 from the IC card connector 10 inserted and used in the equipment will be described.

Figure 9B:
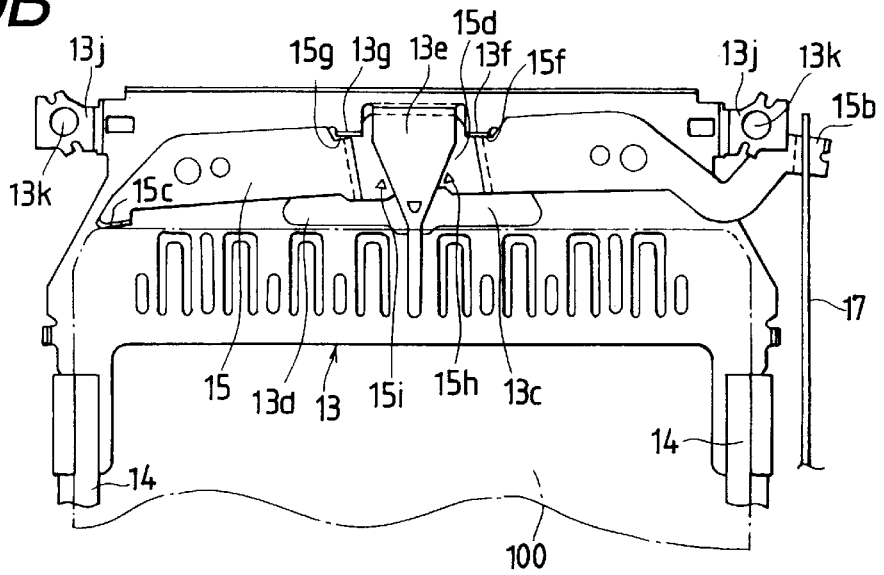
FIG. 9B is a plan view showing the IC card position during ejection from the IC Card connector of one embodiment according to this invention.
Figure 9C:
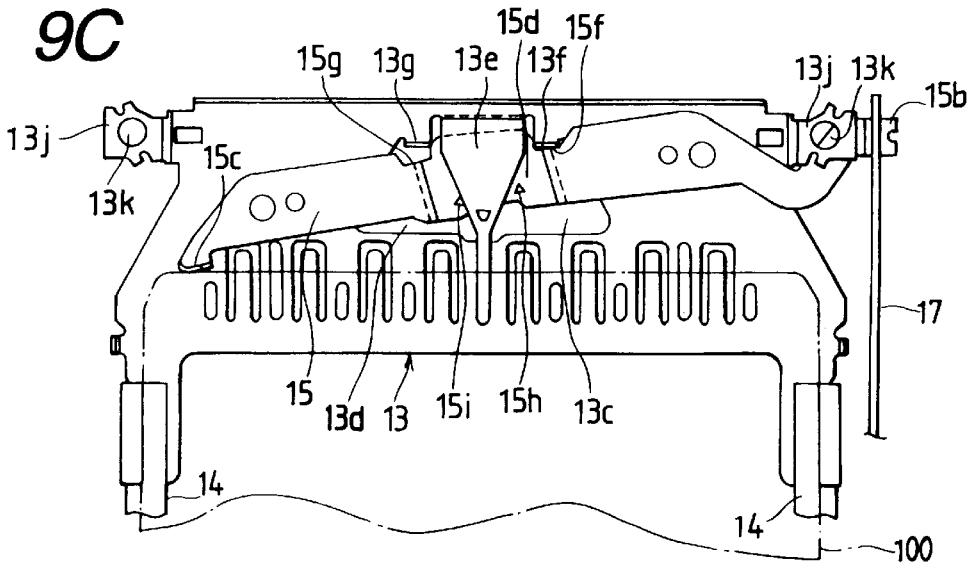
FIG. 9C is a plan view showing the IC card position after ejection from the IC Card connector of one embodiment according to this invention.

FIGS. 9A to 9C are rear plan views in section of equipment with the IC card connector 10 installed; the housing 11 and the printed-circuit board are not depicted for explanation.

First, as the IC card 100 is inserted along the guide grooves 14*a* of the guide member 14 used as a guide, an unillustrated contact portion formed on the forward end of the IC card 100 fits on the pin terminals 12 attached inside of the housing 11, thus completing the insertion of the IC card 100. At this time, in FIG. 9A, the pushing portion 15*c* of the ejecting lever 15 is pressed by the forward end of the IC card 100 in the direction of insertion until the pushing portion 15*c* is positioned in the rearmost position thereof, that is, in a recessed portion 11*d* formed in the base section 11*a* of the housing 11 as shown in FIG. 1.

The retaining portion 15*b* of the ejecting lever 15 is supported on the principle of lever, on one point as a fulcrum of the contact portion between the cutout portion 15*g* of the ejecting lever 15 and the bent portion 13*g* of the frame 13, being positioned in the foremost position. The engaging groove 17*a* of the push rod 17 which is engaged with the retaining portion 15*b* is also pushed forward at the same time to thereby place the operating portion 18 in the foremost position.

To take out the IC card 100 from the IC card connector 10 in the state IC card is thus mounted in the IC card connector 10, the operating portion 18 of the push rod 17 is pushed rearward of the equipment in the direction of insertion of the IC card 100 as shown in FIGS. 9A to 9B.

With the rearward movement of the push rod 17 along the side wall of the guide member 14, the engaging groove 17*a* of the push rod 17 pushes the retaining portion 15*b* of the ejecting lever 15 rearward.

As the retaining portion 15*b* on one end of the ejecting lever 15 is pushed rearward, the pushing portion 15*c* on the other end gradually moves forward, on the principle of lever, on one point of the contact portion as a fulcrum between the cutout portion 15*g* of the ejecting lever 15 and the bent portion 13*g* of the frame 13.

A longer distance is provided between the fulcrum and the retaining portion 15*b* than a distance between the fulcrum and the pushing portion 15*c*; therefore, at the initial stage of ejecting operation, when the ejecting lever 15 is turned on one point of the contact portion as the fulcrum between the cutout portion 15*g* of the ejecting lever 15 and the bent portion 13*g* of the frame 13, a greater force is applied to the pushing portion 15*c* than a slight pushing force exerted tot he push rod 17, thereby enabling smooth removal of the IC card 100 from each pin terminal 12. Thus, a part of the IC card 100 is released from the contact piece 13*b* of the frame 13. The projection 15*h* projecting out of the mounting hole 13*c* functions to restrict this movement, thereby restricting the longitudinal swing of the ejecting lever 15 toward the pushing portion 15*c* side.

Next, when the push rod 17 is kept further recessed, the retaining portion 15*b* of the ejecting lever 15 moves to the rearmost part as shown in FIG. 9C until the ejecting lever 15 contacts the bent portion of the mounting portion 13*j* of the frame 13 which is approximately squarely bent, and stops. The pushing portion 15*c* of the ejecting lever 15 moves forward, together with the IC card 100, on one point of the contact portion as a fulcrum between the bent portion 13*f* of the frame 13 and the cutout portion 15*f* of the ejecting lever 15.

During ejecting operation from the midpoint to the final stage of ejection, the fulcrum moves from one point of the contact portion between the cutout portion 15*g* of the ejecting lever 15 and the bent portion 13*g* of the frame 13 to another point of the contact portion between the cutout portion 15*f* of the ejecting lever 15 to the bent portion 13*f* of the frame 13, thereby providing a shorter distance between the fulcrum and the retaining portion 15*b* than between the fulcrum and the pushing portion 15*c*. Therefore, when the ejecting lever 15 is turned on one point as a fulcrum of the contact portion on the retaining portion 15*b* side of the ejecting lever 15, the pushing portion 15*c* moves largely if the retaining portion 15*b* of the ejecting lever 15 is slightly moved, enabling to increase the ejection stroke of the IC card 100. Furthermore, the projecting portion 15*i* projecting to the mounting hole 13*d* functions as a restricting portion against this movement, thereby restricting the longitudinal movement of the ejecting lever 15 toward the retaining portion 15*b* side.

The IC card 100, therefore, can be driven out from the equipment equipped with the IC card connector 10 by the above-described procedure.

It should be noted that the IC card connector of this invention is not limited to the configuration of the IC card connector 10 which is one embodiment of this invention explained above; for instance the connecting portion 13*e* of the frame 13 connected at both ends to the frame 13 may be of a cantilever structure only on the opposite side, in the direction of insertion, of the IC card 100.

Furthermore, it is to be noticed that the longitudinal movement of the ejecting lever in this invention restricted by the projecting portions 15*h* and 15*i* is not limited thereto, and may be restricted by the engagement of for instance the bent portions 13*f* and 13*g*.

As heretofore explained, the IC card connector of this invention has a housing having terminals, a frame of a flat plate attached to the housing, and an ejecting lever supported on the frame; the flat plate of the frame being provided with a pair of mounting holes and a connecting portion recessed in the direction of plate thickness between he mounting holes; the ejecting lever having a raised portion jutting out in the direction of plate thickness, or in the opposite direction of the connecting portion, and inserted through from ore mounting hole into the other mounting hole astride the connecting portion; the connecting portion being overlapped on the raised portion, so that the surface of the raised portion will be approximately flush with the surface of the flat plate of the frame and also the back side of the connecting portion will be approximately flush with the back side of the ejecting lever. The ejecting lever is also rotatably supported between the connecting portion and the raised portion, so that the IC card connected to the terminals on the housing may be pushed for ejection by means of the ejecting lever. Since the thickness of the ejecting mechanism is determined only by the plate thickness of the frame and the plate thickness of the ejecting lever, the IC card connector on the whole can be decreased in thickness, thereby enabling down-sizing of the equipment.

On either end side of the raised portion is formed a contact portion which can be in contact with the frame; as the ejecting lever turns on one of the contact portions as a fulcrum, the fulcrum moves from the contact portion to the other contact portion, so that when the IC card inserted is removed off the terminals provided on the housing, it is possible to obtain a great ejecting force by utilizing the principle of lever. After the removal of the IC card, the ejection stroke can be increased to enable smooth ejection.

The connecting portion is bridged in the direction of width of the ejecting lever, to prevent the ejecting lever from accidental removal from the frame at the time of ejection lever rotation, thereby insuring smooth, reliable ejecting lever operation.

In the raised portion of the ejecting lever are formed a pair of projecting portions projecting in the opposite direction of the raised portion. The projecting portions function to hold the connecting portion at a given interval, thus restricting the movement of the ejecting lever and accordingly restricting the runout of the ejecting lever. The ejecting lever, therefore, can smoothly turn when operated.

What is claimed is:

1. An IC card connector comprising:

a housing provided with terminals;

a frame attached to the housing; and an ejecting lever supported on the frame;

the frame being made of a flat plate in which a pair of mounting holes are formed, the frame provided with a connecting portion recessed in a direction of plate thickness, the connecting portion disposed between the mounting holes;

the ejecting lever having a raised portion jutting out in an opposite direction of the connecting portion and disposed between the mounting holes;

the connecting portion being overlapped on the raised portion so that a surface of the raised portion will be approximately flush with a surface of the flat plate of the frame and a back side of the connecting portion will approximately flush with a back side of the ejecting lever;

the ejecting lever rotatably supported between the connecting portion and the raised portion to drive an inserted IC card off the terminals of the housing when pushed.

2. An IC card connector according to claim 1, wherein on each end side of the raised portion is formed a contact portion to contact the frame and, as the ejecting lever turns on one of the contact portions as a fulcrum, the fulcrum moves from the one of the contact portions to the other of the contact portions.

3. An IC card connector according to claim 1, wherein the connecting portion is bridged in a direction of width of the ejecting lever.

4. An IC card connector according to claim 1, wherein the ejecting lever has a pair of projecting portions on the raised portion, the projecting portions projecting toward the connecting portion to hold the connecting portion and disposed on either side of the connecting portion, thereby restricting movement of the ejecting lever.

5. An IC card connector comprising:

a housing on which a plurality of terminals connectable to an inserted IC card are provided;

a frame attached to the housing to cover the housing, the frame including a flat portion, the flat portion having an inner surface and an outer surface, an inside and an outside, a pair of mounting holes opposing each other at a predetermined distance, and a connecting portion disposed between the mounting holes and having an outer surface; and an ejecting lever having a thickness and overlapping the inner surface of the flat portion of the frame, the ejecting lever having an intermediate portion projecting towards the outside of the frame by an amount of the thickness of the ejecting lever to form a raised portion having a flat part and an outer surface, the ejecting lever also having a flat portion with an outer surface, the ejecting lever to push the inserted IC card in a removing direction, the connecting portion projecting towards the inside of the flat portion of the frame by the amount of the thickness of the ejecting lever, the ejecting layer inserted through the mounting holes and passing over the connecting portion, the flat part of the raised portion in planar contact with the connecting portion, the outer surface of the flat portion of the frame excepting the connecting portion approximately flush with the outer surface of the raised portion of the ejecting lever, the outer surface of the flat portion of the ejecting lever excepting the raised portion approximately flush with the outer surface of the connecting portion of the frame, the ejecting lever rotatably supported along the inner surface of the flat portion of the frame, rotation of the ejecting lever occurring with the flat part of the raised portion in planar contact with the connecting portion.

6. An IC card connector according to claim 5, wherein:

a pushing portion is formed on one end of the ejecting lever to push out the inserted IC card, a bent portion is formed on opposing sides of the frame across from the connecting portion, one of the opposing sides being proximate to the pushing portion and the other of the opposing sides being distal from the pushing portion, the bent portion is formed by forming two notches from the pair of mounting holes and bending and raising a portion of the frame between the notches, a contact portion is formed on the opposing sides of the frame, the contact portion on each side of the frame contacting each of the bent portions and serving as a fulcrum when the ejecting lever is rotated, and after the ejecting lever is rotated with the contact portion on the side proximate to the pushing portion being the fulcrum, the fulcrum moves to the contact portion on the distal side from the pushing portion.

7. An IC card connector according to claim 5, wherein the mounting holes are formed side by side along a direction in which the terminals are formed in the housing.

8. An IC card connector according to claim 5, wherein the flat part of the raised portion of the ejecting lever has a pair of projecting portions formed on opposing sides of the ejecting lever across from the connecting portion and the projecting portions project toward the inside of the flat portion of the frame, thereby restricting movement of the ejecting lever in a direction in which the terminals are formed in the housing.

* * * * *